United States Patent [19]

Phillips

[11] Patent Number: 4,677,798

[45] Date of Patent: Jul. 7, 1987

[54] STEEL SHELL MODULES FOR PRISONER DETENTION FACILITIES

[76] Inventor: Edward H. Phillips, P.O. Box 979, Fort Collins, Colo. 80522

[21] Appl. No.: 852,021

[22] Filed: Apr. 14, 1986

[51] Int. Cl.[4] ..... E04H 3/08

[52] U.S. Cl. ..... 52/106; 52/79.4; 52/79.9; 52/144; 52/404; 109/79

[58] Field of Search ..... 52/106, 79.1, 79.4, 52/79.5, 79.9, 79.12, 144, 243, 404; 109/78, 79

[56] References Cited

U.S. PATENT DOCUMENTS

| | | | |
|---|---|---|---|
| 1,100,804 | 6/1914 | White . | |
| 3,312,019 | 4/1967 | Faerber | 52/106 |
| 3,722,152 | 3/1973 | Schlatter et al. | 52/106 X |
| 3,769,766 | 11/1973 | Speidel | 52/79.4 |
| 3,899,043 | 8/1975 | Hall | 52/79.9 X |
| 4,494,348 | 1/1985 | Kastelic | 52/404 X |

*Primary Examiner*—J. Karl Bell

*Attorney, Agent, or Firm*—Laurence R. Brown

[57] ABSTRACT

Vandalism resistant building modules suitable for detention and secured storage facilities provide good architectural properties and significant resistance to noise, fire and impact. Thus, steel shell modules are welded together to produce steel inner and outer walls. The modules contain strengthening and bullet deflecting internally directed steel baffles and various types of insulating materials. Construction is facilitated by providing modules that are welded together along only two lines coinciding with mating end positions on the steel plate inner and outer walls. Three steel panel pieces are formed into a module, each being partly triangular in cross section so that only one weld seam between two of the panels is required in assembling the three pieces which thereby form the internal baffles at angles for deflecting bullets. The baffles form an intermediate barrier between the walls and flanges at the ends of the module between which an insulating rope is compressed to provide a thermal and sound barrier between the inner and outer steel walls. Different types of internally disposed insulating materials may be disposed on either side of the intermediate barrier thus to provide the best combination of impact, fire and sound resistant properties.

26 Claims, 18 Drawing Figures

STEEL SHELL MODULES FOR PRISONER DETENTION FACILITIES

TECHNICAL FIELD

This invention relates to modular building construction techniques and more particularly it relates to prisoner detention facilities such as jails and jail cells constructed from building modules.

BACKGROUND ART

When overflow detention facilities are needed for jails or corresponding secured facilities for storage vaults, it is pertinent that quick construction may be available without sacrifice of desired security features, whether the construction be temporary or permanent.

Both desirable architectural and functional features are unusually demanding in secured facilities. The load bearing ratings may need be greater than in other types of building construction because of vandalism possibilities. In any event the usual architectural loads for building weights and building loading weights such as bank vaults need be accommodated. Acceptable building appearance and upkeep is an essential feature. In the present state of the building arts it is conventional to use modular construction techniques. Thus, for example, building facings may be modularized for both appearance and ease or cost of construction, with a major part of the assembly and construction being done efficiently in large numbers at a module production center. However, it is not usual to have the entire building or outer wall construction made of modular building elements of such small sizes that they can be conveniently handled manually.

Furthermore the functional features required for secured facilities have not heretofore been available in modular form. To appreciate the critical nature of these features, the environment for jail facilities need be understood. Several types of vandalism need be considered, including jailbreak efforts, riot conditions with attempts to destroy property by fire, impact or explosion and defacing of internal construction. Also the facilities need be sanitary and easily maintained in sanitary condition. There is also concern for adequate creature comforts in terms of temperature, lighting and ventilation. No modular units have been available for meeting these critical specialty needs.

Modularized jail construction has been suggested by N. A. Faerber in U.S. Pat. No. 3,312,019 issued Apr. 4, 1967. However this equipment did not meet many security needs such as sound proofing, impact resistance to great forces such as explosions and projectiles. It is particularly vulnerable to vandalism and noise disturbances because of its single layer panel construction that is easily damaged and which transmits noise with little attenuation, and possibly with amplification due to the vibration propensity of large single layer panels.

It is therefore an objective of this invention to provide modules specially adapted to jail cell security conditions that may be used wherever vandalism and entry security is desired as well as exceptional fire, noise and impact resistance.

DISCLOSURE OF THE INVENTION

This invention provides modular equipment for formulating detention structures comprising of a multiplicity of interchangeable modules of similar size having steel plate inner and outer wall sections defining end closures and internally directed load supporting baffles. The modules comprise three steel plate wall panel sections of partially triangular cross section shape positioned to provide the internally directed baffles and the end closure walls. Modules of a size that may be manually processed are abutted together end to end in registration and welded together along two weld lines to form walls for the detention structure. The ends are indented so that the two weld lines at the wall section surfaces are the sole lines of registered contact.

The baffles provided by the triangular shaped panels to extend inwardly form an intermediate interlocking barrier with the baffles disposed at such angles that bullets which might penetrate the outer steel panels are deflected. Flanges are formed between the inner and outer wall panels between which a ropelike insulating seal is compressed to isolate the two walls. Two different kinds of filler insulating material may be inserted on opposite sides of the intermediate layer to increase the versatility of the modules. Thus, insulation properties, impact properties or load bearing properties may be emphasized by the appropriate filler materials.

Accordingly jail or other detention structures may have substantially sound, impact and fire resistant characteristics. Thus, vandalism resistance is provided. The exterior steel plate walls are smooth and strong and easy to decorate and maintain. The modules may carry utility instruments and utility flow lines. This construction is also ideal for storage vault use, safety barriers and other secure facilities.

BRIEF DESCRIPTION OF THE DRAWINGS

Like reference characters designate similar features throughout the accompanying drawings, in which.

Figure 1:
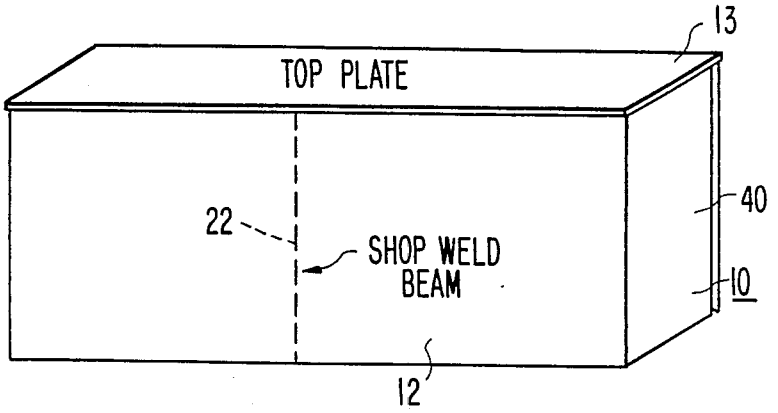
FIGS. 1, 2 and 3 are respectively perspective line drawing views of building module construction afforded by this invention showing the closed module with a top plate, an assembled module before the top plate is affixed and an enlarged end segment.

There are a number of requirements or security storage vaults, detention facilities and jail cells that are not available in prior art construction techniques. It is however desirable to have steel walls, both inner and outer.

That provides the several advantages of ease of maintenance, building strength, ease of sanitation and security against vandalism and destruction. One serious problem is that noise is easily generated and amplified by vibrating or resonance when the walls are struck. This problem was alleviated by H. E. White in U.S. Pat. No. 1,100,804, June 23, 1914 by making jail cell walls of hollow steel panels and filling the space between the panels with a sound deadening material such as concrete.

Fire resistance is also a very real problem, particularly when vandalism is a possibility, and safety assurance is necessary. Thin steel walls have little heat resisting capability, and this disadvantage need be overcome to be able to effectively use steel walls. Steel is also costly, and heavy. Thus to have high load bearing strength for supporting a heavy load of stored materials, such as paper files or instruments that need a protective environment, is costly and requires special handling equipment because of the weight of the panels when used in building construction. It is therefore one object of the present invention to provide low cost building construction materials using thinner guage steel panels without sacrificing economy and the ability to handle manually.

In secured facilities, and protective barriers, it is feasible that projectiles may be encountered, such as bullets from high powered guns or bomb fragments. There have not been effective ways of dealing with these powerful impact weapons with inexpensive housing in the prior art.

At present there is a considerable lack of prisoner housing and detention space available, and thus a need has developed for inexpensive temporary and permanent housing. Prior art construction techniques are not suitable for providing quick jail cell construction at low cost. In particular conventional prior art techniques are unacceptable in providing secure facilities. Neither wood nor masonry is generally acceptable in vandal proof qualities. Wood easily burns, or is penetrable with easily available instruments. It may not be wholly sanitary. Masonry is not usually impact resistant in the presence of projectiles and particularly when mortar is involved may not be able to detain ingenious escape minded prisoners. There are no known acceptable synthetic materials that have ideal properties for safety, detention, comfort, strength and resistance to various forms of vandalism, such as noise, impact and fire. Accordingly, it is an object of this invention to provide new construction materials and techniques that are particularly useful in detention barriers and cells.

In particular, even though modular building blocks, such as bricks, have long been used in construction, and larger prefabricated modules are used in modern construction methods, they are not suitable for use in jail cells and the like. Yet there is a significant economic advantage if prefabrication of standard modules is possible, particularly if modules are of a size that can be handled manually in the field without special cranes or equipment. It is an objective of this invention to achieve that.

Thus, as shown in the drawings, this invention provides building modules adapted to fit together for construction of fire, sound and impact resistant security barriers and rooms for use in securing records and persons. In particular jail cells, protection barriers and security storage vaults may be constructed in situ with prefabricated modules with few field labor hours and requiring a minimum of special construction equipment.

The module 10 thus has an outer steel shell of substantially parallelepiped shape with two outer steel plate panel sections of greater surface area 11, 12 serving as inner and outer walls for a structure when a plurality of the modules are fitted together. Top and bottom plates 13, 14 are provided either for each of the modules or at the bottom and top of the walls formed by the modules when stacked upon each other.

To increase the load bearing capacity and to permit the module steel plate shells to be of small guage means are disposed inside the shell for increasing its load bearing capacity. That may comprise at least in part inwardly directed steel baffles 15, 16. Also filler materials of various sorts, useful for other purposes such as insulation as well, will keep the steel shells from buckling, and fillers such as concrete may add considerable strength to the modules.

Figure 2:
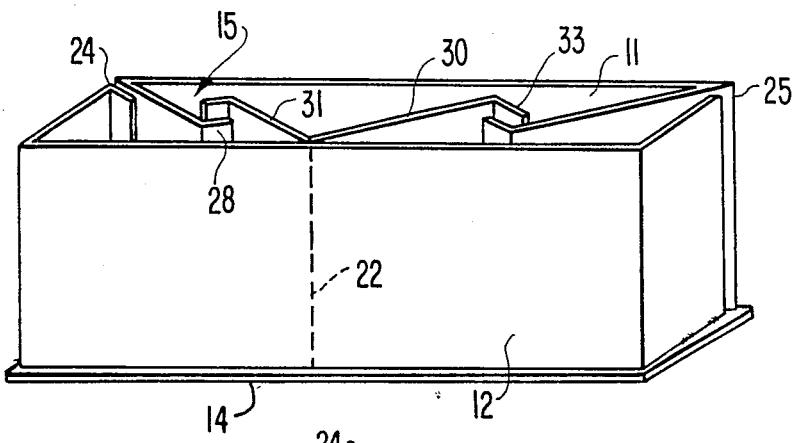
Figure 4:
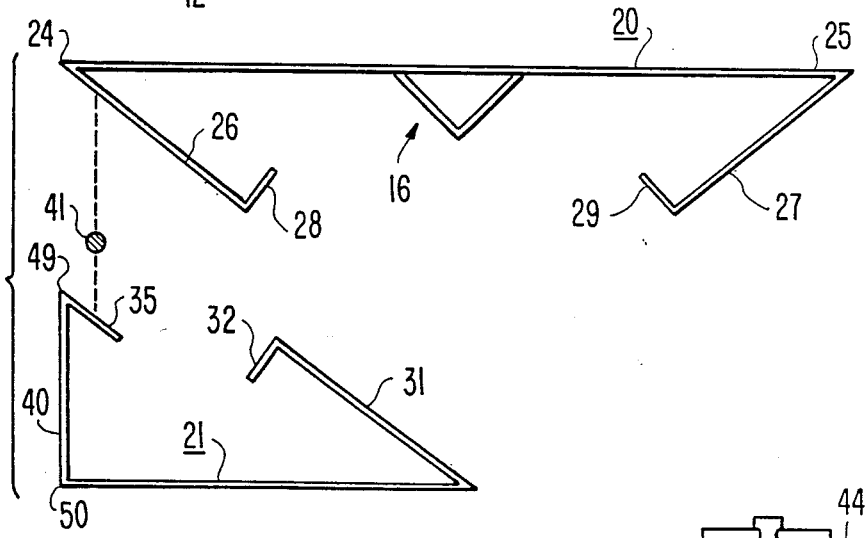
FIG. 4 is an exploded line drawing plan view sketch showing two shaped steel plate panel elements arranged in spaced relationship before moving together to form inner and outer wall panels on the building modules afforded by this invention.

The modules are constructed not only for ease in prefabrication, but for ease in in-situ assembly in the field. Thus, with particular reference to FIGS. 2 and 4, it may be seen that each module has its side and end walls formed from two kinds of standard panel sections, 20, 21. In the panel section 20, the load bearing baffles 16 are optionally used with longer panels or smaller guage panel thicknesses, and are thus shown in phantom view. Two of the shorter panel sections 21 meet at a center shop weld seam 22.

The longer panel sections 20 comprise a cross section shape substantially that of the base and two partial legs of a triangle forming acute angles having apex points at opposite ends 24, 25 of the completed module. This construction affords integrally attached inwardly pointing baffles 26, 27, with end flanges 28, 29. Thus the only welds necessary for panel 20 are for the strengthening triangular baffle 16, if used.

Two of the shorter panel sections 21 abutted together, with each extending substantially half the dimension of the triangle base wall 11 of the longer panel, similarly form internally directed baffles 30, 31 and corresponding end flanges 32, 33. In these shorter panel sections, the flanges 35 is also formed on the end walls of the modules. These panel sections 21 then form in cross section a part of a substantially right triangle having the right angle leg forming the end walls 40 of the module.

Figure 5:
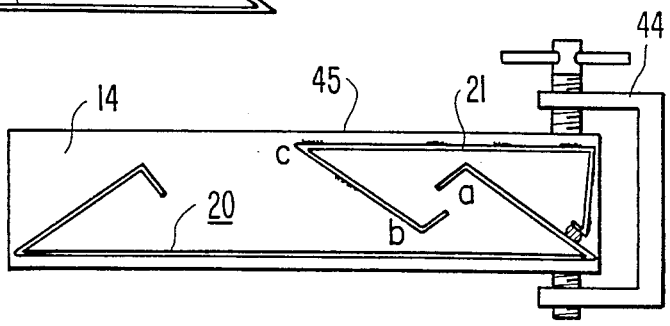
FIG. 5 is a plan view sketch of an assembly jig used with the building module in an assembly step.

The two opposing panels 20, 21, are spaced by sealant means such as glass fiber rope, 41, which is compressed between the flange 35 and the baffle 26, such as by means of the clamp 44 in FIG. 5. The panels 20, 21 are then welded in place to the base plate 14, such as at 45, etc. This provides an insulating barrier keeping the front and rear panel sections from steel to steel contact with each other by a thermal-acoustical barrier material. Thus transmission of sound, for example by pounding on the inner jail cell wall by a detained inmate, as otherwise carried by steel to steel contact to the outer wall is substantially restricted.

Figure 3:
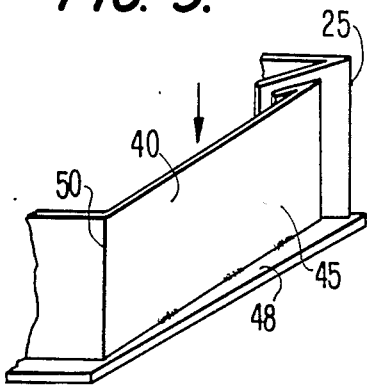

As best seen from FIG. 3, the module ends 40 are not perpendicular to the front and back panel facings 11 and 12. Thus the apex 49 of the right angle triangular panel section 21 is displaced inwardly toward the center of the module from the apex 25 of the longer panel section 20. The end plate 40 thus is at an angle 48 of a few degrees. As a result there is only line contact between adjacent modules along the apex 25 and along the apex 50 when the modules are assembled in registration by welding the two modules together. Thus only the seam 22 and the corresponding seams along the apex lines 25 and 50 need be finished by sanding, etc. to provide smooth inner and outer wall surfaces.

Figure 6:
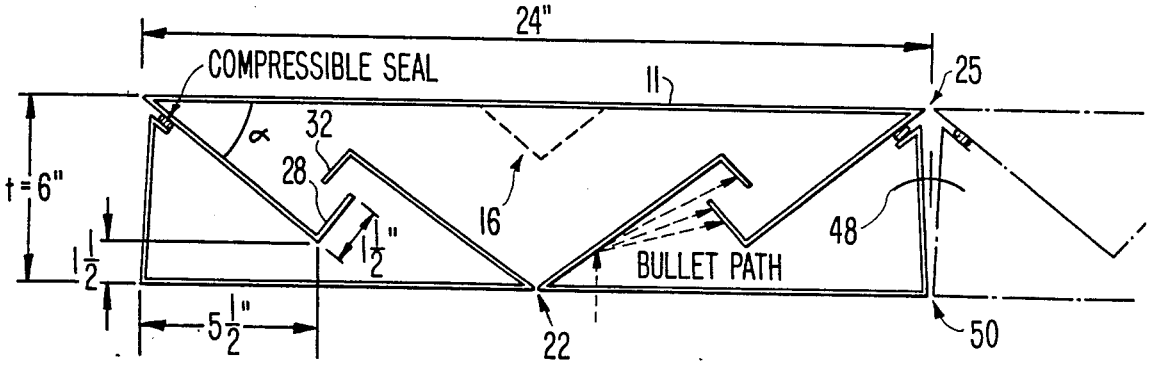
FIG. 6 is a plan line drawing section view through an assembled module providing typical dimensions and showing the end to end mating with similar modules in phantom view.

FIG. 6 shows the end to end relationship of two such mated modules. This Figure also shows preferred dimensions of modules that may be manually processed without special cranes or other on site tooling, except for appropriate welding apparatus. It is clear that the labor cost of the on site assembly is minimal and the economic advantages of pre-fabricated factory controlled modules provides low cost and quickly erected buildings in accordance with this invention.

The additional feature of this module construction is that it gives additional protection against projectile penetration. Thus it may be seen from FIG. 6 that if a bullet were to penetrate the outer steel shell wall, the baffles are disposed at angles which tend to deflect the bullets. This then affords a higher degree of protection with lighter guage steel in the outer module shell. Note that even at the weld seam 22, which may of itself provide more strength for stopping projectiles, if a bullet were to penetrate directly, the rear wall baffle 16 may also serve as a deflection baffle.

Figure 7:
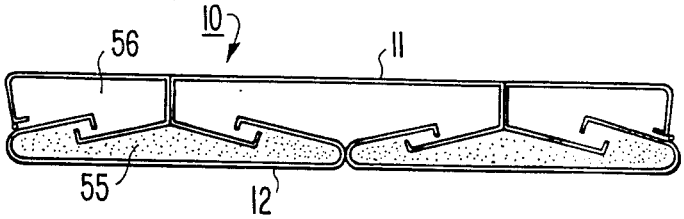
FIG. 7 is a section line view through the module showing the baffle construction and the internally disposed insulation materials for one embodiment of the invention.

As may be seen from the module 10 of FIG. 7, the overlapping flanges 28, 32, etc. provide for overlapping and interlocking the baffles to produce substantially an intermediate barrier wall between the opposite faces 11 and 12. Thus, two different types of insulation may be used in the subcompartments 55 and 56 adjacent the opposite module walls. Thus, in compartment 55 a mixture of gravel or river rock with gypsum will provide substantial resistance to bullet penetration and also is good fire resist insulation. Compartment 56 then might contain rock wool or other type sound and thermal insulation. Accordingly the module characteristics may be easily custom tailored for the specific needs of each installation.

For different security levels the wall thicknesses may by varied. Typically 14 to 10 guage steel may be used. The fillers may also contribute to strength and security. Thus concrete or reinforced concrete may be used as a filler, or gravel may have an epoxy binder, etc.

Figure 8:
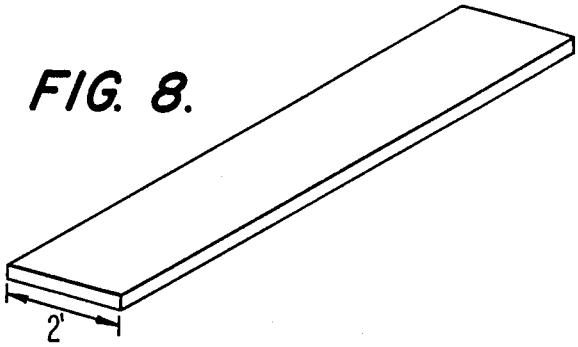
FIG. 8 is a perspective view of a roofing module.
Figure 9:
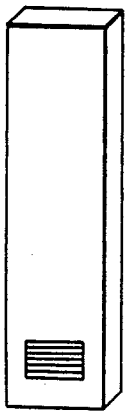
FIGS. 9, 10 and 11 are perspective views of module construction with utility accessories and flow paths.
Figure 10:
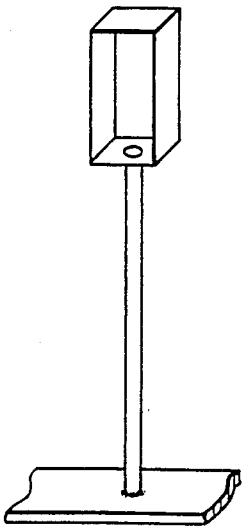
Figure 11:
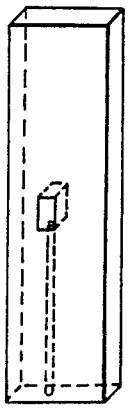

Although buildings, cells and barriers may be built primarily of these modules, a set of cooperating special purpose modules is convenient for other building blocks, thus contributing to lower cost and faster construction. For example, a top roofing member is shown in FIG. 8. The hollow construction permits secure and escape proof cells with utility flow access channels and outlets typically as shown in FIGS. 9 to 11. Air flow and electric wiring is easily provided in this manner.

Figure 12:
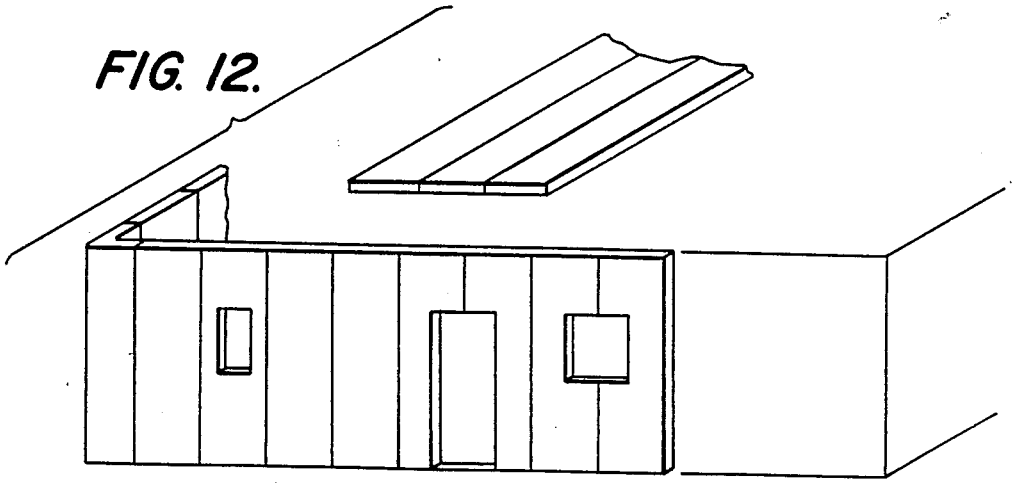
FIG. 12 is a perspective exploded sketch of a cell or prisoner detention facility constructed in accordance with the invention.
Figure 13:
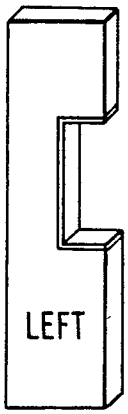
FIGS. 13 to 18 are perspective sketches of modules provided by the invention to form openings such as doors and windows.
Figure 14:
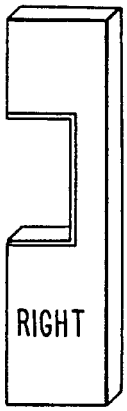
Figure 15:
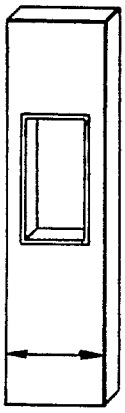
Figure 16:
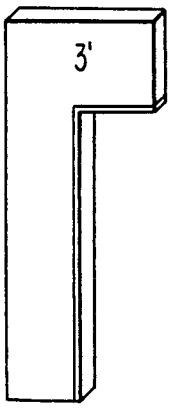
Figure 17:
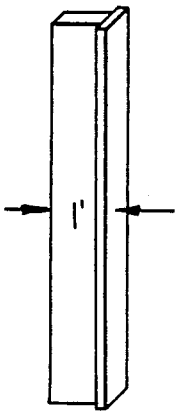
Figure 18:
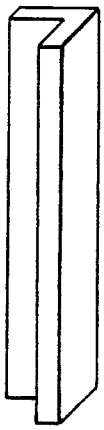

As seen in the building sketch of FIG. 12, provision may need be made for doors and windows. The special modules of FIGS. 13 to 18 provide for matched registration in place in a building of compatible modules. Heavy steel plates may be provided for hanging doors, etc. Small windows as in FIG. 15 may be pre-installed at the plant, and larger ones fitting between the modules of FIGS. 13 and 14 may be installed in the field by welding in place.

The walls of the building of FIG. 12 may be simply barrier walls used for security purposes in impeding autos or other impact instruments. Thus the modular building construction afforded by this invention provides significant advantage wherever security provisions need be provided. Typical wall characteristics include bullet and explosion resistance, fire and heat resistance, acoustic insulation, ease of manual assembly on site, and high structural strength. Thus the modules and modular construction of this invention is particularly adapted to use in jails, bank vaults, armories, firing ranges, embassy security areas, barrier walls, military applications and in special construction requiring unusual thermal, noise and impact resistance combined with architectural needs in construction safety and strength, sanitation and ease of maintenance.

Therefore this invention has advanced the art by providing modular buildings and modules of high strength, bullet resistance, extraordinary acoustical and thermal insulation, easy site construction with convenient manually installable module sizes. Uniquely the advantages of steel shell modules are combined with thermal and acoustical isolation of two spaced walls and protection against bullet penetration of the walls. Accordingly those novel features believed descriptive of the nature and spirit of the invention are defined with particularity in the claims.

I claim:

1. Building modules adapted to fit together for construction of fire, sound and impact resistant security barriers and rooms for use in securing records and persons, comprising in combination, an outer shell of substantially parallelepiped shaped with two outer steel plate panel sections of greater surface area serving as inner and outer walls for a structure when a plurality of the modules are fitted together, sealant means spacing the two panel sections from steel to steel contact with each other by a thermal-acoustical barrier material, and further means disposed inside the shell for increasing its load bearing capacity comprising internal steel baffles extending inwardly from the steel shell walls.

2. Modules as defined in claim 1 wherein the steel baffles are oriented with the panel sections disposed at angles for deflecting projectiles such as bullets able to penetrate the steel plates.

3. Modules as defined in claim 2 including insulating material disposed inside said shell to provide significant resistance to penetration and travel of projectiles that might penetrate the plates.

4. Building modules adapted to fit together for construction of fire, sound and impact resistant security barriers and rooms for use in securing records and persons, comprising in combination, an outer shell of substantially parallelepiped shape with two outer steel plate panel sections of greater surface area serving as inner and outer walls for a structure when a plurality of the modules are fitted together, sealant means spacing the two panel sections from steel to steel contact with each other by a thermal-acoustical barrier material, and further means disposed inside the shell for increasing its load bearing capacity wherein a first outer steel plate panel section comprises a cross section shape substantially that of the base and two partial legs of a triangle forming acute angles having apex points at opposite ends of the module and wherein the legs are inwardly directed to provide internal baffles.

5. Modules as defined in claim 4 wherein the other outer steel panel section comprises two abutted parts each extending substantially half the dimension of the triangle base of the first panel and each comprising a cross section shape substantially that of the base and two partial legs of a substantially right triangle having the right angle leg forming end walls of the modules and the remaining leg directed internally and thereby forming an internal baffle.

6. Modules as defined in claim 5 wherein the internal baffles of both outer panel sections overlap and interlock at angles providing deflector panels extending from one end of the module to the other for changing the direction of projectiles that might penetrate the outer wall.

7. Modules as defined in claim 5 wherein the substantially right angle leg forming the module end walls is slightly less than 90 degrees to produce end walls on the modules which thereby abut with similar modules at the outer wall panel ends at substantially only two lines along the height of the panels at the respective ends of the two outer panel sections.

8. Modules as defined in claim 7 placed end to end with the two abutting lines of the end to end modules in abutted registration and welded together along the two abutted lines.

9. Modules as defined in claim 8 forming a barrier wall.

10. Modules as defined in claim 8 forming a jail cell, with the modules providing fire resistance, sound barrier, thermal insulation, projectile repellant characteristics and high impact resistance.

11. Modules as defined in claim 8 forming a security storage facility with the modules providing fire resistance, thermal insulation and high impact resistance.

12. Modules as defined in claim 5 wherein the two panel sections form with said internal baffles a confronting pair of flanges near each end of the module, and further including means fixing the panels in place with a ropelike thermal seal extending between and being compressed by the flanges along the height of the panels.

13. Modules as defined in claim 5 wherein closure plates are affixed as top and bottom panels to the wall panels.

14. Modules as defined in claim 13 wherein the modules are filled with an insulating material providing thermal and acoustical insulation and energy absorption.

15. Modules as defined in claim 13 wherein the deflector panels form substantially two internal compartments respectively abutting the outer steel plate panels and wherein the insulating material in each of the compartments differ.

16. Modules as defined in claim 13 wherein the insulating material in the compartment abutting one outer wall is a mixture of gravel and gypsum.

17. Projectile resistant building modules for fitting together to form steel wall surfaces in construction of jail cells and the like comprising a steel plate outer shell, inner steel baffles projecting inwardly from the outer shell at angles tending to deflect projectiles that penetrate the outer shell and internal packing material that significantly resists the travel of a moving projectile.

18. Modules as defined in claim 17 welded together to form barrier walls with steel plate surfaces.

19. Modules as defined in claim 18 having sound, thermal and impact resisting insulating material within the shells and with the walls forming secured facilities for confining internal fire, sound and impact disturbances within the facilities and for providing impact and projectile resistance from vandalism and outside disturbances.

20. Modules as defined in claim 18 having fire, impact and thermal resisting insulating material within the shells and joined together to provide secured facilities for storage of materials.

21. A prisoner detention facility providing vandalism resistance constructed of modular shells having outer steel plate wall panels welded together to provide unitary inner and outer steel walls and internal baffles, with the modular shells enclosing insulating material providing substantial thermal, sound and impact resistance.

22. Modular equipment for formulating detention structures comprising of a multiplicity of interchangeable modules of similar size having steel plate inner and outer wall sections defining end closures and internally directed load supporting baffles with said modules welded together to form said detention structure.

23. Modular equipment as defined in claim 22 wherein the internally directed baffles are disposed at angles for deflecting projectiles such as bullets which might penetrate the outer steel plate walls.

24. Modular equipment as defined in claim 22 including insulation material inside the modules for resisting fire, sound and impact.

25. Modular equipment as defined in claim 22 including modular shape for abutting modules end to end in registration to meet substantially only along two welded lines appearing at the inner and outer wall outer surfaces, wherein the multiplicity of modules are welded together along the two weld lines.

26. Modular equipment as defined in claim 22 including means defined in the end closures disposing thermal insulation between the inner and outer walls to interrupt steel to steel contact.

* * * * *